US007228757B2

(12) United States Patent
Peniston et al.

(10) Patent No.: US 7,228,757 B2
(45) Date of Patent: Jun. 12, 2007

(54) ADJUSTABLE FOOT PEDAL ASSEMBLY

(75) Inventors: Charles R. Peniston, Quakertown, PA (US); William Doucet, Royersford, PA (US); Dustin Harvey, East Coventry, PA (US)

(73) Assignee: Teleflex Incorporated, Limerick, PA (US)

( * ) Notice: Subject to any disclaimer, the term of this patent is extended or adjusted under 35 U.S.C. 154(b) by 168 days.

(21) Appl. No.: 10/667,210

(22) Filed: Sep. 19, 2003

(65) Prior Publication Data

US 2004/0134305 A1 Jul. 15, 2004

Related U.S. Application Data

(60) Provisional application No. 60/412,466, filed on Sep. 21, 2002, provisional application No. 60/426,754, filed on Nov. 15, 2002.

(51) Int. Cl.
*G05G 1/14* (2006.01)

(52) U.S. Cl. ..... 74/512

(58) Field of Classification Search ..... 74/512, 74/513, 560, 478; 180/334
See application file for complete search history.

(56) References Cited

U.S. PATENT DOCUMENTS 3,536,229 A * 10/1970 Boros ..... 477/193
4,499,963 A * 2/1985 Liston ..... 180/90.6
5,964,125 A * 10/1999 Rixon et al. ..... 74/514
6,151,984 A * 11/2000 Johansson et al. ..... 74/512
6,305,239 B1 * 10/2001 Johansson et al. ..... 74/512
6,364,047 B1 * 4/2002 Bortolon ..... 180/334
2002/0078784 A1 * 6/2002 Hayashihara ..... 74/512
2002/0157497 A1 * 10/2002 Porter et al. ..... 74/512
2003/0164058 A1 * 9/2003 Sauvonnet et al. ..... 74/512
2004/0020323 A1 * 2/2004 Harth et al. ..... 74/512

* cited by examiner

*Primary Examiner*—Vicky A. Johnson
(74) *Attorney, Agent, or Firm*—Baker & Hostetler LLP

(57) ABSTRACT

In an adjustable foot pedal assembly for a vehicle, a brake pedal is supported on a carrier, which is adjustable fore and aft. A brake valve has a valve body fixed relative to the path of carrier movement, and a plunger movable in a direction transverse to the path of carrier movement. A transfer arm, pivoted on the carrier, is operatively connected to the foot pedal and the plunger, for effecting movement of the plunger in response to depression of the foot pedal so that the relationship between the movement of the foot pedal and the responsive movement of the plunger is independent of the position of the carrier. The brake valve does not need to be moved as the pedal position is adjusted, and the brake pedal characteristics are therefore unaffected by adjustment of the position of the pedal.

16 Claims, 5 Drawing Sheets

ADJUSTABLE FOOT PEDAL ASSEMBLY

CROSS-REFERENCE TO RELATED APPLICATIONS

This application claims the benefit of provisional patent applications 60/412,466, filed Sep. 21, 2002, and 60/426,754, filed Nov. 15, 2002.

FIELD OF THE INVENTION

This invention relates to an adjustable foot pedal assembly suitable for use in control applications to adapt the position of one or more foot pedals to the size of a human operator. The invention has particular application in motor vehicles such as buses, heavy trucks, motor homes and the like.

BACKGROUND OF THE INVENTION

In a motor vehicle, it is important, for the comfort of the operator, and for safe operation of the vehicle, to be able to adjust the position of the operator's feet relative to the control pedals of the vehicle. In automobiles, this is generally accomplished by fore and aft adjustment of the operator's seat, or by a combination of fore and aft adjustment and vertical adjustment. However, in larger vehicles, seat adjustment is frequently not provided. Where seat adjustment is provided, whether in an automobile or in a larger vehicle, it can give rise to other problems, such as dangers associated with seat track failure, and positioning the operator too close to the steering wheel, or too low for proper vision of the road.

Various pedal position adjustment mechanisms have been proposed. Examples are the adjustable suspended pedal mechanisms described in U.S. Pat. Nos. 5,964,125, 6,151,984, 6,305,239 and 6,374,695, the adjustable floor pedal systems described in U.S. Pat. No. 6,364,047 and U.S. patent publication 2002/0157497.

In U.S. Pat. No. 6,364,047, a floating floor is adjustable fore and aft by a motor. The floating floor carries not only the pedals, e.g. a brake and throttle pedal, but also electrical transducers which produce electrical signals in response to pedal movement. In U.S. patent publication 2002/0157497, the brake component is carried along with the pedal, and connected to the vehicle brakes via flexible hydraulic hoses.

In many vehicles, although the throttle is electrically controlled, the brake is operated pneumatically or hydraulically. An electrical transducer can be mounted on a floating floor without giving rise to serious problems. However, a hydraulic or pneumatic valve requires fluid lines, which are typically relatively stiff, and would be liable to fail, due to cracking or chafing as a result of repeated flexure, if connected to a floating floor. Moreover, these brake valves are relatively heavy, and it is not practical to mount them for movement along with a pedal. On the other hand attempting to operate a fixed brake valve from a brake pedal mounted on a floating floor would entail other problems, namely, making a simple mechanical connection between the adjustable brake pedal and the fixed brake valve, and maintaining a uniform brake pedal effort throughout the range of pedal position adjustment.

BRIEF SUMMARY OF THE INVENTION

The principal object of this invention is to provide a pedal adjustment mechanism that can be utilized in conjunction with a fixed control device such as a fluid valve, and in which the pedal effort remains uniform throughout the range of pedal position adjustment. It is also an object of the invention to provide a pedal adjustment mechanism that is structurally simple, relatively inexpensive and easy to install, and reliable in operation.

The adjustable foot pedal assembly in accordance with the invention comprises a carrier for supporting at least one foot pedal; a guide for guiding the carrier for movement through a limited range, both in a first direction along a path of movement and in an opposite direction; a foot pedal mounted on the carrier and movable relative to the carrier in response to depression by a person's foot; a control device having a body fixed relative to the path of carrier movement and a plunger movable relative to the body in a direction transverse to the path of carrier movement; and a linkage, operatively connected to the foot pedal and the plunger, for effecting movement of the plunger in response to depression of the foot pedal, the relationship between the movement of the foot pedal and the responsive movement of the plunger being independent of the position of the carrier within its limited range.

Preferably, the linkage comprises an arm having upward and downward facing parts, the upward facing part being engaged with a part of the foot pedal and the downward facing part being engaged with the plunger whereby depression of the foot pedal effects downward movement of the plunger. The arm, and at least one of the pedal and the plunger, are movable relative to each other along a direction parallel to the path of movement of the carrier. The arm is preferably pivoted, and mounted on the carrier.

The foot pedal assembly has the advantage that the control device can remain in a fixed position even through the carrier can be adjusted, and the effort applied to the pedal to effect a given movement of the plunger of the control device is constant irrespective of the position of the carrier.

Other objects, details and advantages of the invention will be apparent from the following detailed description when read in conjunction with the drawings.

DETAILED DESCRIPTION OF THE PREFERRED EMBODIMENT

Figure 1:
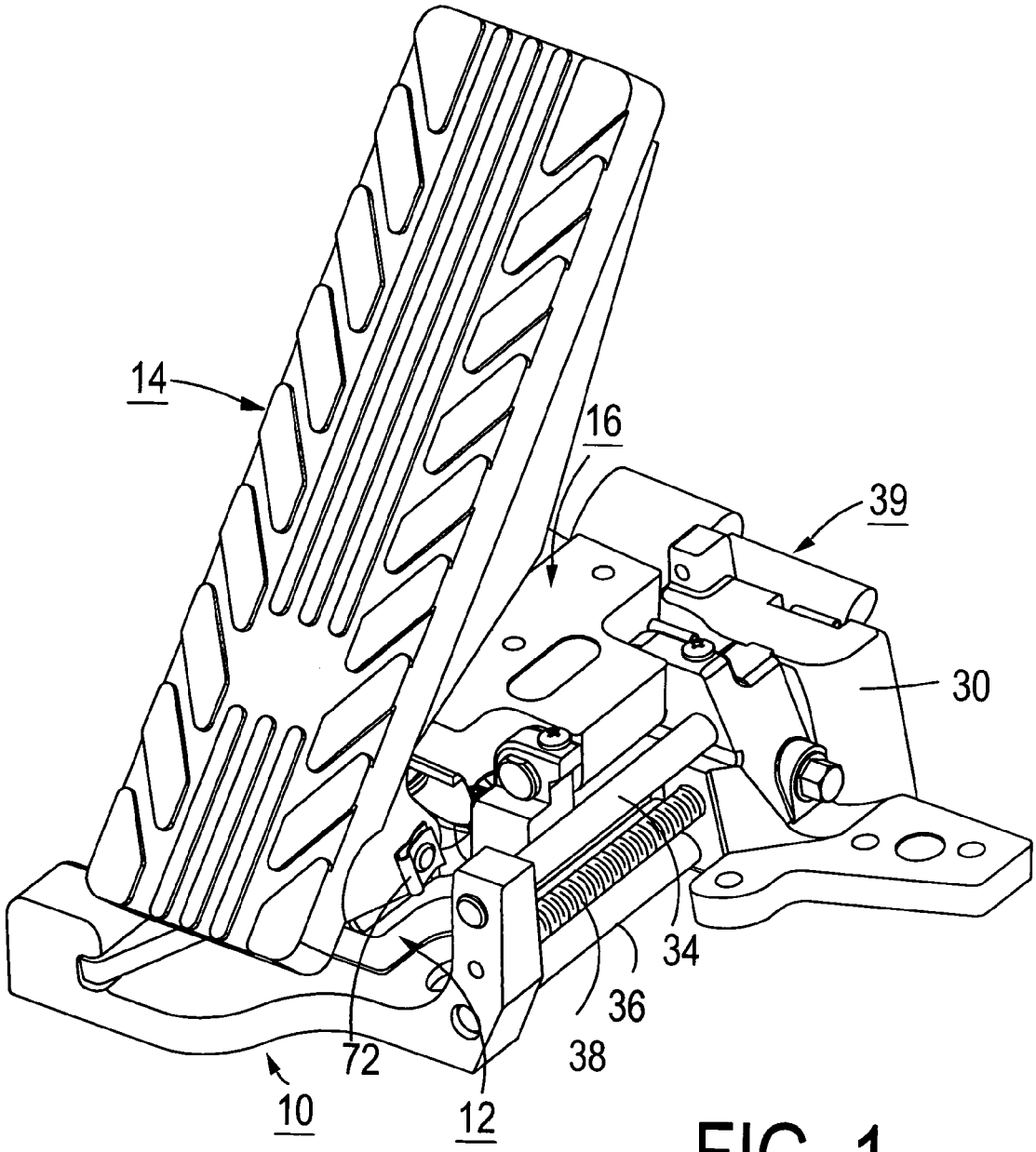
FIG. 1 is a perspective view a pedal of an adjustable foot pedal assembly in accordance with the invention, showing a pedal and its carrier in a forward position.

As shown in FIG. 1, the preferred adjustable foot pedal assembly in accordance with the invention includes, as its principal components, a base 10, a carrier 12, a foot-operable brake pedal 14, and a pivoting force transfer arm 16, which serves as a plunger operator, linking the pedal to the plunger of a brake valve.

Figure 5:
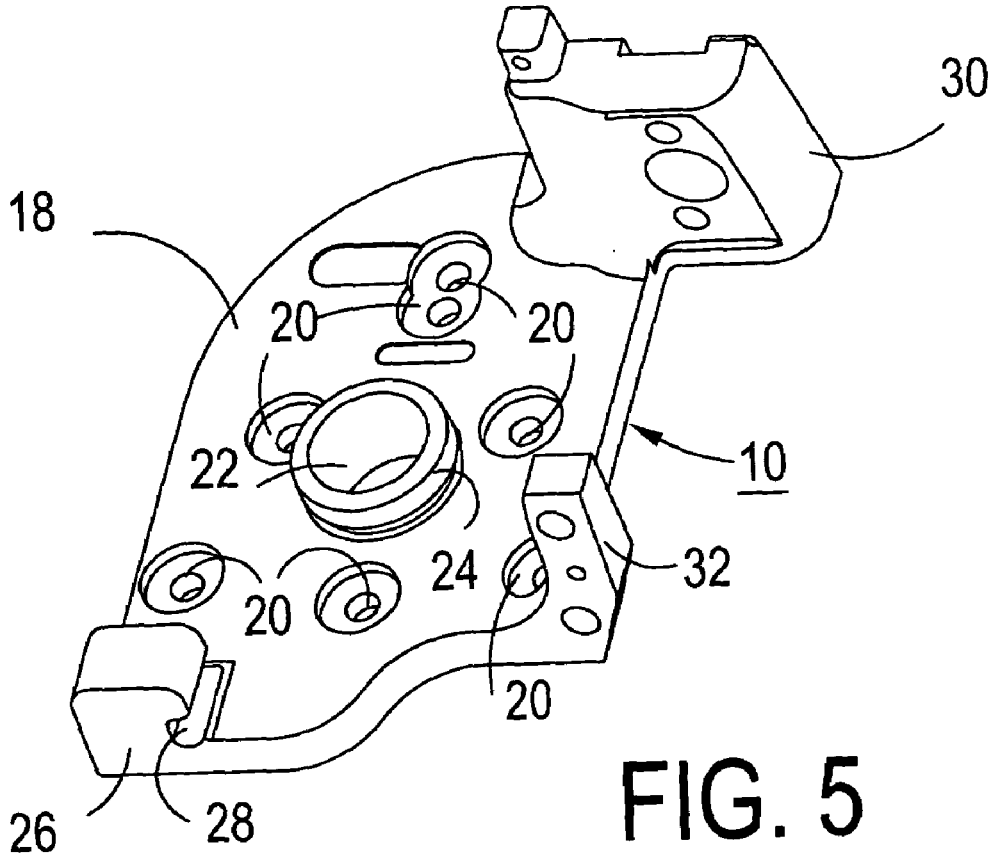
FIG. 5 is a perspective view of a base.

The base 10, shown separately in FIG. 5, is a metal casting comprising a plate 18, adapted to be secured in fixed relationship to the floor of a vehicle by mounting bolts (not shown) extending through mounting holes 20. An opening 22, surrounded by a collar 24, is provided in the plate 18 for receiving a hydraulic brake valve (not shown in FIG. 5), of the kind which is typically fixed to the floor of a vehicle, with the body of the brake valve located underneath the floor, and its plunger extending upward through the floor. When the base 10 is installed in the vehicle, it is positioned so that the plunger of the brake valve extends upward through opening 22, so that the brake can be operated by depression of the plunger.

As shown in FIG. 5, a guide 26, formed as an integral part of the base at the left rear corner, has a guide slot 28. This slot extends in the front to rear direction, with its opening facing toward the right so that it can slidably receive a left-hand edge of the carrier 12 (FIG. 1), guiding the carrier as it moves forwardly and rearwardly. The base also has front and rear brackets 30 and 32, to which upper and lower carrier guide rods 34 and 36 (FIG. 1) are secured, and which also support a carrier drive screw 38 (FIG. 1), rotatably driven by an electric motor and reduction gear assembly 39 mounted on rear bracket 30.

The carrier 12 is also a metal casting. As shown in FIG. 4, the carrier has a first pair of brackets, 40 and 42, formed as an integral part of the carrier, for pivotally supporting the brake pedal 14 (FIG. 1), and a second pair of brackets, 44 and 46, also formed as an integral part of the carrier, for pivotally supporting the transfer arm 16 (FIG. 1). The brackets 40 and 42 receive a pedal mounting pin 48, shown in FIG. 3, and brackets 44 and 46 receive a pin 50 for pivotally mounting the transfer arm 16. These two pins extend at a right angle relationship to each other, and accordingly the brake pedal and the transfer arm pivot about axes that are disposed at a right angle relationship. The pivot axes may, but do not necessarily, intersect each other. In the embodiment shown, the pivot axis of the transfer arm is slightly higher than the pivot axis of the brake pedal.

Again referring to FIG. 4, the carrier 12 is provided with a rearward projection 52 at its left rear corner. This projection has a straight edge 54, extending in the front to rear direction, which enters guide slot 28 (FIG. 5) of the base. The carrier also has a projection 56 extending to the right from a location adjacent bracket 46. Projection 56 is used to mount a throttle pedal (not shown), which is typically coupled to the throttle of the vehicle's engine by an electrical control, a flexible control cable, or other suitable coupling. The carrier has first and second holes 58 and 60, formed in bracket 46, for slidable engagement with guide rods 34 and 36, respectively (FIG. 1). A threaded third hole 62 is formed in bracket 46, between holes 58 and 60, for threading engagement with drive screw 38 (FIG. 1). The carrier position, and thus the positions of both the brake pedal and the throttle pedal, can be adjusted in the front to rear direction, by operation of the electric motor and reduction gear assembly 39, to rotate the drive screw 38.

Figure 3:
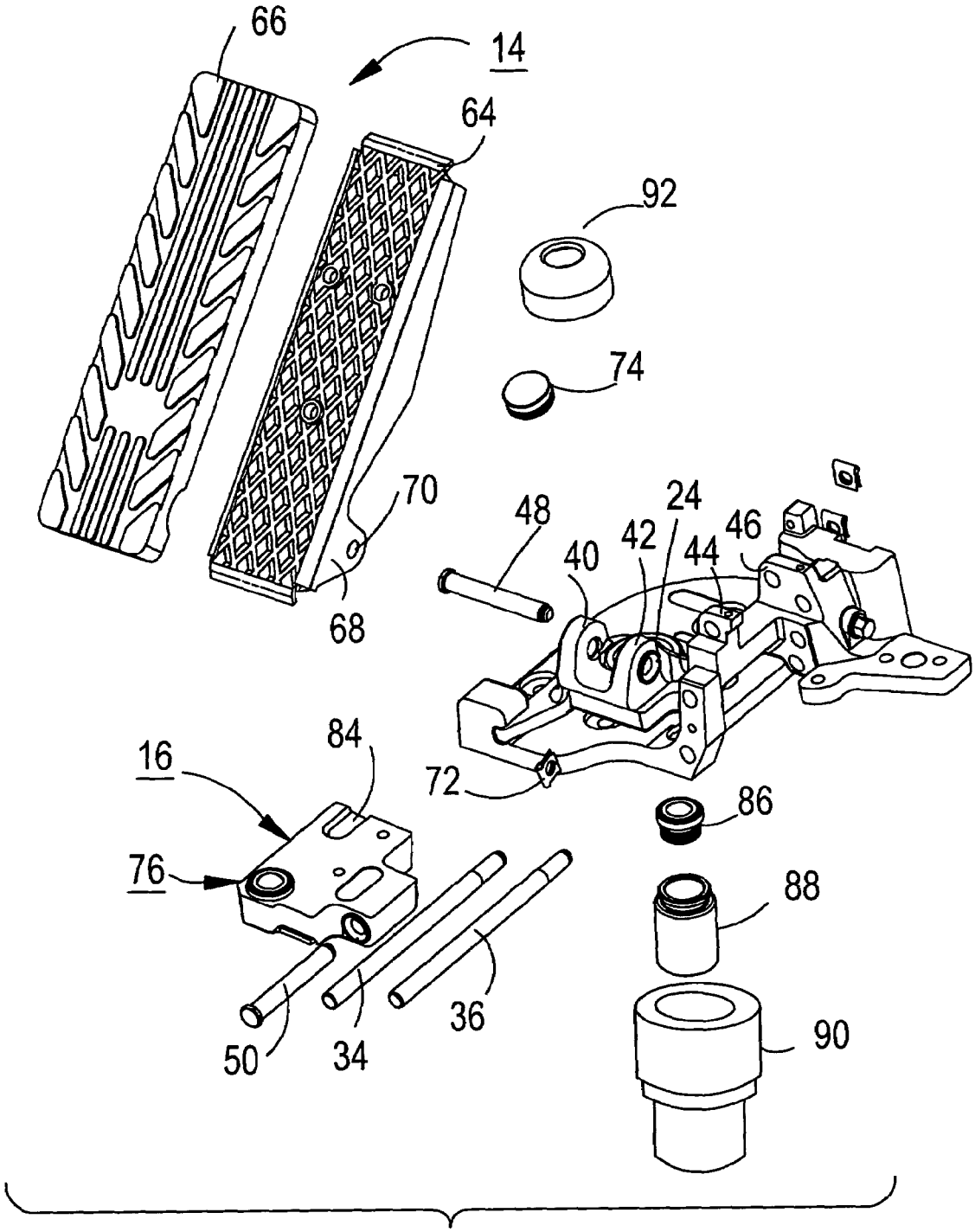
FIG. 3 is an exploded perspective view of the adjustable foot pedal assembly.
Figure 4:
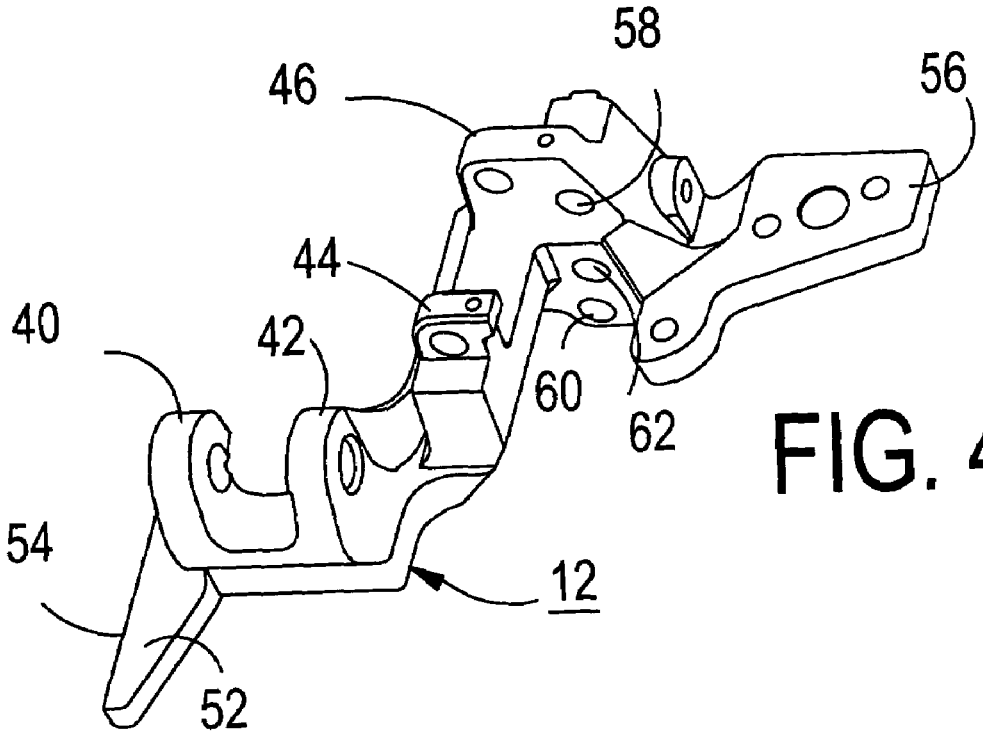
FIG. 4 is a perspective view of the movable pedal carrier.

As shown in FIG. 3, the brake pedal 14 comprises a cast metal part 64 and a rubber cover 66. The metal part has a pair of opposed plates, one of which is shown at 68, which straddle the pair of brackets 40 and 42 on the base. Mounting pin 48 extends through hole 70 in plate 68 and a corresponding hole in the opposed plate (not shown), and through holes in the brackets 40 and 42. The pin is secured in place by a spring clip fastener 72.

Figure 6:
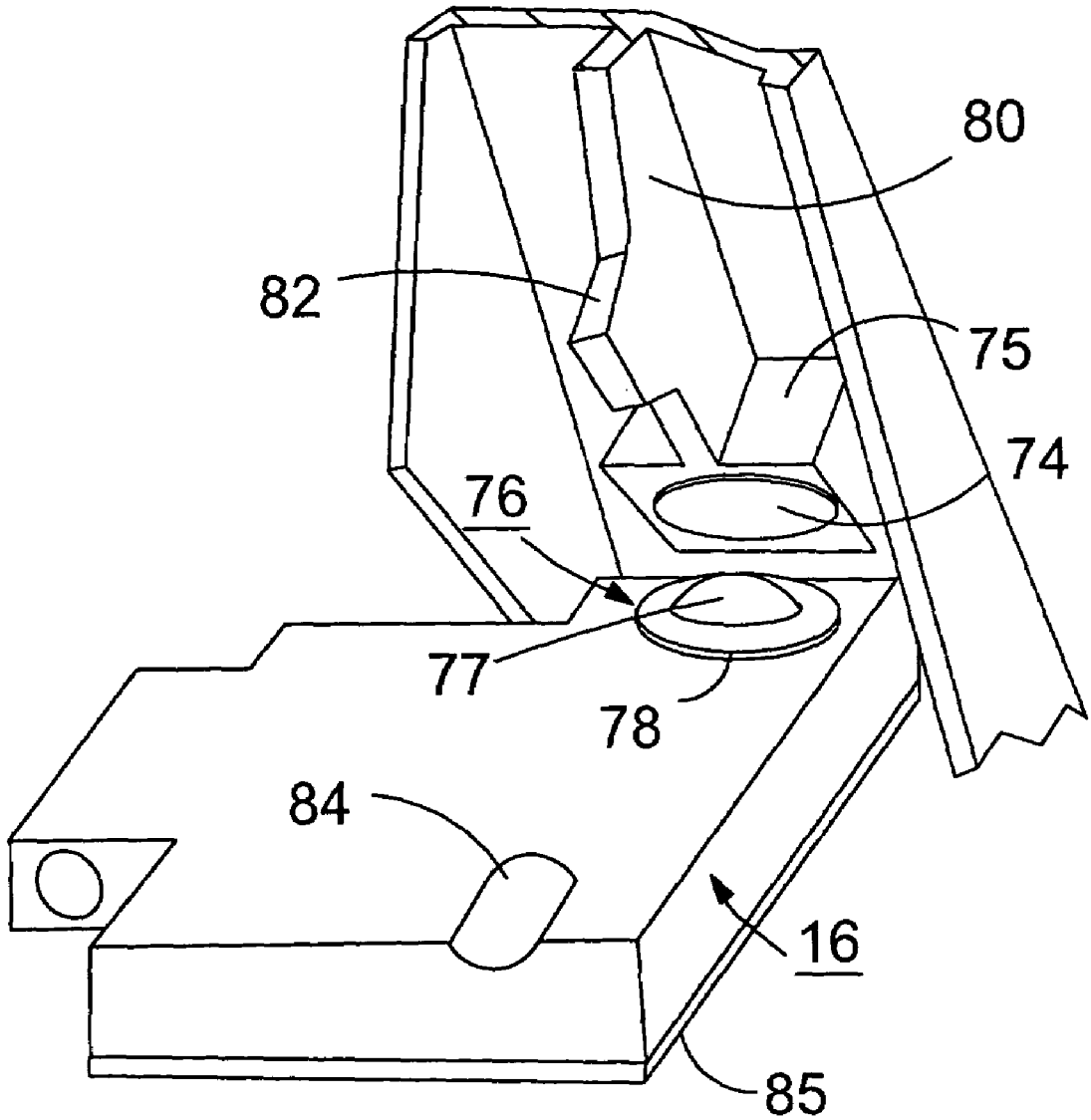
FIG. 6 is a bottom view of the pedal.

As shown in FIG. 6, a hardened steel, disc-shaped, wear insert 74 fits into a recess in an enlargement 75 formed on the underside of the metal part 64 of the pedal, for engagement with a force transfer ball mechanism 76 provided as part of the transfer arm 16. The force transfer ball mechanism consists of a relatively large ball 77 mounted in a plastic retainer 78, and resting on a plurality of smaller balls (not shown) inside the retainer. Its purpose is to effect smooth transfer of force from the pedal to the transfer arm as the angular relationship between the pedal and the transfer arm changes.

The wear insert is located near the pivot axis of the pedal and the force transfer ball mechanism is positioned near the rear edge of the transfer arm. The pedal also has a centrally located plate 80 with a downwardly extending projection 82, which is receivable in a recess 84 formed in the top face of the transfer arm 16 adjacent the front edge of the transfer arm. The engagement of the projection 82 with the recess 84 occurs when the transfer arm reaches the limit of its downward pivoting movement, and prevents excessive force from being exerted by the wear insert 74 on the force transfer ball mechanism 76. The bottom of the transfer arm has a hardened wear plate 85 (FIG. 6), which, in turn, engages another transfer ball mechanism 86 (FIG. 3), similar to mechanism 76, at the upper end of a plunger 88 of a brake valve 90. A flexible protective seal 92 is engaged with the plunger 88 and the collar 24 on the base, to keep dust and debris away from lubricating grease provided at the location at which the plunger 88 enters the cylinder portion of the brake valve.

Figure 2:
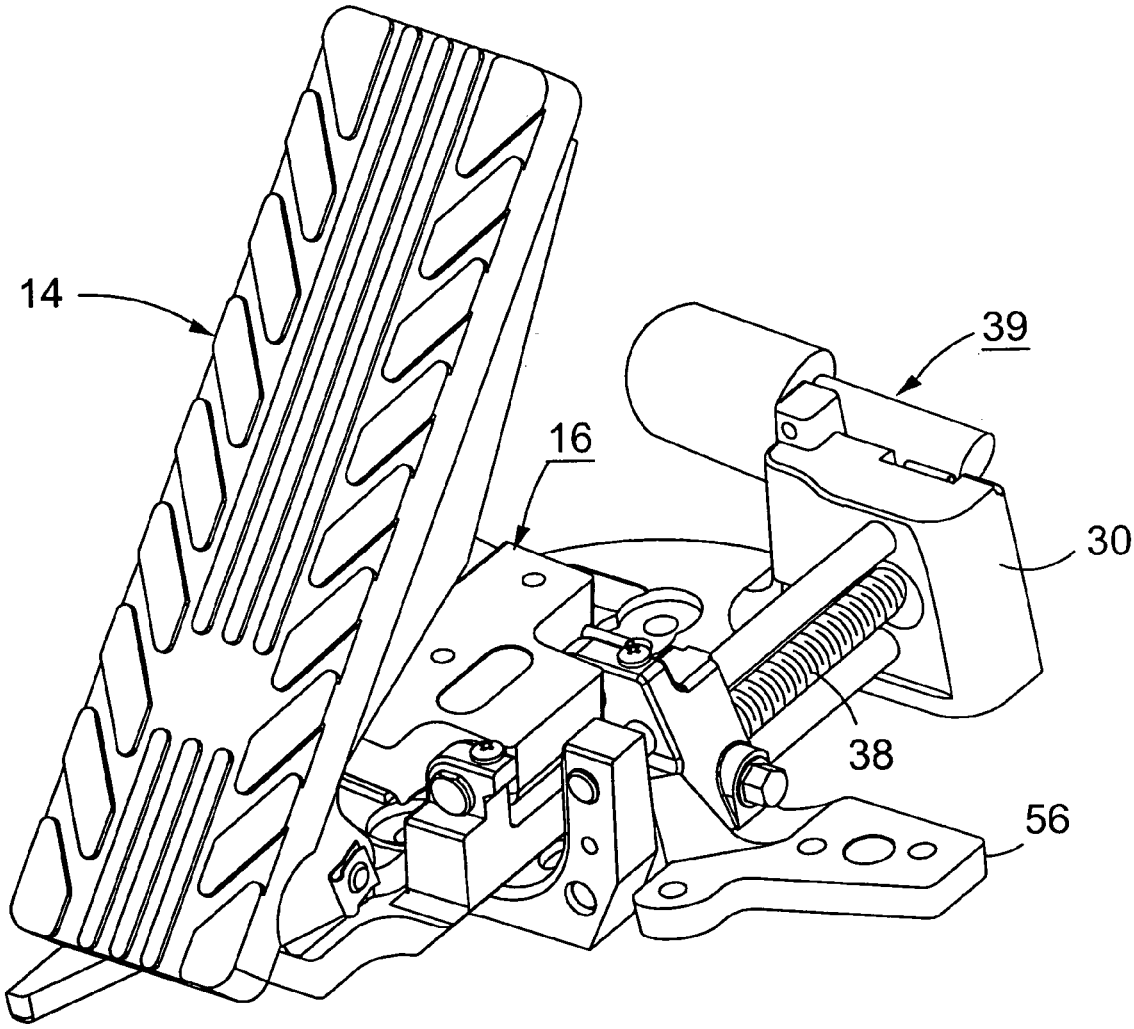
FIG. 2 is a perspective view of an adjustable foot pedal assembly in accordance with the invention, showing the pedal and its carrier in a rearward position.

As shown in FIG. 2, the carrier can be moved toward its rearmost position by operation of drive screw 38. Electrical controls (not shown), including limit switches, may be provided to enable the vehicle operator to adjust the position of the brake pedal 14, and a throttle pedal mounted on bracket 56, to any desired position in the range from the position shown in FIG. 1 to the position shown in FIG. 2. As the carrier moves in the forward and rearward directions on the base, the transfer arm slides over the brake valve plunger. However, at any position within the range of movement of the pedal carrier, the operation of the transfer arm ensures that the effect of the pedal 14 on the brake valve plunger will not vary. That is, any given angular movement of the pedal produces the same corresponding movement of the plunger, irrespective of the position of the carrier. Therefore, the ratio of the torque applied to the pedal to the force applied to the plunger of the brake valve remains substantially constant, and the pedal effort characteristic does not vary with changes in the position of the pedal carrier.

As will be apparent from the above description, the adjustable foot pedal assembly provides for fore and aft adjustment of the positions of one or more pedals, but allows a control device such as a pneumatic or hydraulic brake valve to remain at a fixed location without the position adjustment of the pedals having an effect on the pedal operating characteristics.

The mechanism described provides significant ergonomic advantages in that it allows drivers of different stature to operate a vehicle safely and comfortably, without adjusting the driver's seat to awkward and unsafe positions. At the same time, it reduces the risks and difficulties associated with movement of a brake valve, including abrasion and potential rupture of fluid lines, while ensuring a uniform pedal effort characteristic regardless of the position of the pedal carrier.

Although the embodiment described above is considered to be the preferred embodiment, similar benefits can be realized in other embodiments.

For example, although in the preferred embodiment, the transfer arm is pivoted on the carrier, and moves longitudinally relative to the brake valve as the carrier position is adjusted, in an alternative embodiment, the longitudinal position of the transfer arm can be fixed relative to the brake valve, and the longitudinal position of the brake pedal relative to the transfer arm can be adjusted. This alternative configuration can be realized, for example, by attaching a roller to the pedal for engagement with a transfer arm. It is also possible to make the transfer arm movable longitudinally relative to the brake valve, and to make the pedal movable relative to the transfer arm. Such a configuration would enable a relatively short transfer arm could be used, but would be considerably more complex than the preferred embodiment.

In another alternative embodiment, the pedal can rotate a shaft through first arm, and the shaft can, in turn rotate a brake valve operating arm. Either the first arm or the brake valve operating arm can be splined to the shaft in order to allow the longitudinal position of the pedal relative the brake valve to be adjusted without affecting the pedal effort characteristic.

Various modifications can be made to the mechanism described. For example, instead of being pivoted, the transfer arm can be mounted on suitable guides for vertical translation in response to pedal operation. The carrier can be guided for fore and aft movement by various alternative guide configurations. Moreover, although a motor-operated screw is desirable for adjustment of the carrier position, provision can be made for manual adjustment.

Still other modifications may be made to the apparatus and method described above without departing from the scope of the invention as defined in the following claims.

What is claimed is:

1. An adjustable foot pedal assembly comprising:

a carrier for supporting at least one foot pedal;

a guide, guiding the carrier for movement through a limited range along a path of movement;

a foot pedal mounted on the carrier and movable relative to the carrier in response to depression by a person's foot;

a control device having a body fixed relative to said guide and a plunger movable relative to said body in a direction transverse to said path of movement; and a linkage, operatively connected to said foot pedal and said plunger, for effecting movement of said plunger in said direction transverse to said path of movement in response to depression of said foot pedal, the relationship between the movement of the foot pedal and the responsive movement of the plunger being independent of the position of said carrier within said limited range.

2. An adjustable foot pedal assembly according to claim 1, in which said linkage comprises an arm having upward and downward facing parts, the upward facing part of the arm being engaged with a part of said foot pedal and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

3. An adjustable foot pedal assembly according to claim 1, in which said linkage comprises an arm pivoted for rotation about an axis substantially parallel to said path of movement, said arm having upward and downward facing parts, the upward facing part of the arm being engaged with a part of said foot pedal, and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

4. An adjustable foot pedal assembly according to claim 1, in which said linkage comprises an arm mounted on the carrier and pivoted on the carrier for rotation about an axis substantially parallel to said path of movement, said arm having upward and downward facing parts, the upward facing part of the arm being engaged with a part of said foot pedal, and the downward facing part being engaged with said plunger whereby depression of the foot pedal effects downward movement of the plunger, and said arm being movable relative to said plunger along a direction parallel to said path of movement as the carrier moves in said first or opposite directions.

5. An adjustable foot pedal assembly according to claim 1, including a drive mechanism, connected to the carrier, for moving the carrier both in a first direction along said path of movement, and in an opposite direction.

6. An adjustable foot pedal assembly comprising:

a carrier for supporting at least one foot pedal;

a guide, guiding the carrier for movement through a limited range along a path of movement;

a foot pedal mounted on the carrier and movable relative to the carrier in response to depression by a person's foot;

a control device having a body fixed relative to said guide and a plunger movable relative to said body in a direction transverse to said path of movement; and a plunger operator, operatively connected to said foot pedal and said plunger, for effecting movement of said plunger in said direction transverse to said path of movement in response to depression of said foot pedal, irrespective of the position of said carrier within said limited range;

wherein the plunger operator is positioned in relation to the foot pedal and the plunger is positioned in relation to the plunger operator so that the relationship between the movement of the foot pedal and the movement of the plunger is independent of the position of said carrier.

7. An adjustable foot pedal assembly according to claim 6, in which said plunger operator comprises an arm having upward and downward facing parts, the upward facing part of the arm being engaged with apart of said foot pedal and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

8. An adjustable foot pedal assembly according to claim 6, in which said plunger operator comprises an arm pivoted for rotation about an axis substantially parallel to said path of movement, said arm having upward and downward facing parts, the upward facing part of the arm being engaged with a part of said foot pedal, and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

9. An adjustable foot pedal assembly according to claim 6, in which said plunger operator comprises an arm mounted on the carrier and pivoted on the carrier for rotation about an axis substantially parallel to said path of movement, said arm having upward and downward facing parts, the upward facing part of the arm being engaged with a part of said foot pedal, and the downward facing part being engaged with said plunger whereby depression of the foot pedal effects downward movement of the plunger, and said arm being movable relative to said plunger along a direction parallel to said path of movement as the carrier moves in said first or opposite directions.

10. An adjustable foot pedal assembly according to claim 6, including a drive mechanism, connected to the carrier, for moving the carrier both in a first direction along said path of movement, and in an opposite direction.

11. An adjustable foot pedal assembly comprising:

a carrier for supporting at least one foot pedal;

a guide, guiding the carrier for movement through a limited range along a path of movement;

a foot pedal mounted on the carrier and movable relative to the carrier in response to depression by a person's foot;

a control device having a body fixed relative to said guide and a plunger movable relative to said body in a direction transverse to said path of movement;

a plunger operator having a surface engageable with said plunger, said plunger operator being responsive to depression of said foot pedal for effecting movement of said plunger in said direction transverse to said path of movement, irrespective of the position of said carrier within said limited range;

wherein the plunger operator is positioned in relation to the foot pedal so that the relationship between the movement of the foot pedal and the movement of the plunger operator is independent of the position of said carrier; and wherein the plunger is positioned in relation to the plunger operator so that the relationship between the movement of the plunger operator and the plunger is also independent of the position of said carrier.

12. An adjustable foot pedal assembly according to claim 11, in which said plunger operator comprises an arm having upward and downward facing parts, the upward facing part of the arm being engaged with a part of said foot pedal and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

13. An adjustable foot pedal assembly according to claim 11, in which said plunger operator comprises an arm pivoted for rotation about an axis substantially parallel to said path of movement, said arm having upward and downward facing parts, the upward facing part of the arm being engaged with apart of said foot pedal, and the downward facing part being engaged with said plunger whereby depression of the foot pedal effects downward movement of the plunger, and said arm, and at least one of said pedal and said plunger, being movable relative to each other along a direction parallel to said path of movement as the carrier moves in said first or opposite directions.

14. An adjustable foot pedal assembly according to claim 11, in which said plunger operator comprises an arm mounted on the carrier and pivoted on the carrier for rotation about an axis substantially parallel to said path of movement, said arm having upward and downward facing parts, the upward facing part of the arm being engaged with a part of said foot pedal, and the downward facing part being engaged with said plunger whereby depression of the foot pedal effects downward movement of the plunger, and said arm being movable relative to said plunger along a direction parallel to said path of movement as the carrier moves in said first or opposite directions.

15. An adjustable foot pedal assembly according to claim 11, including a drive mechanism, connected to the carrier, for moving the carrier both in a first direction along said path of movement, and in an opposite direction.

16. An adjustable foot pedal assembly comprising:

a base that includes a mounting interface to fixedly attach the base to a vehicle floor and a control device opening to fixedly receive a control device;

a carrier moveably coupled to the base, the carrier including a foot pedal support;

a transfer arm coupled to the carrier to provide substantially vertical actuation in response to foot pedal movement;

a foot pedal pivotally coupled to the carrier by way of the foot pedal support, wherein the foot pedal engages an upper surface of the transfer arm to actuate the transfer arm; and a control device that extends upward through the control device opening and includes a first ball mechanism, wherein a lower surface of the transfer arm engages the first ball mechanism to actuate the control device, and the transfer arm further includes a second ball mechanism on the upper surface to interface with the foot pedal.

* * * * *